US011435681B2

(12) United States Patent
Kondo et al.

(10) Patent No.: US 11,435,681 B2
(45) Date of Patent: Sep. 6, 2022

(54) RECORDING MATERIAL COOLING DEVICE, IMAGE FORMING APPARATUS AND IMAGE FORMING SYSTEM

(71) Applicant: CANON KABUSHIKI KAISHA, Tokyo (JP)

(72) Inventors: Keita Kondo, Ibaraki (JP); Kenichi Tanaka, Ibaraki (JP); Shingo Katano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/236,787

(22) Filed: Apr. 21, 2021

(65) Prior Publication Data

US 2021/0373465 A1 Dec. 2, 2021

(30) Foreign Application Priority Data

May 26, 2020 (JP) ..... JP2020-091181
Apr. 6, 2021 (JP) ..... JP2021-064780

(51) Int. Cl.
*G03G 15/20* (2006.01)
*G03G 21/20* (2006.01)

(52) U.S. Cl.
CPC ..... *G03G 15/2021* (2013.01); *G03G 15/2028* (2013.01); *G03G 21/206* (2013.01)

(58) Field of Classification Search
CPC ..... G03G 15/2021
See application file for complete search history.

(56) References Cited

U.S. PATENT DOCUMENTS

| | | | | |
|---|---|---|---|---|
| 8,655,242 | B2 | 2/2014 | Tanaka | 399/323 |
| 8,942,612 | B2 | 1/2015 | Tanaka | 399/330 |
| 9,069,299 | B2 | 6/2015 | Tanaka | G03G 15/2028 |
| 9,354,562 | B2 | 5/2016 | Tanaka | G03G 15/2028 |
| 9,389,554 | B2 | 7/2016 | Tanaka et al. | G03G 15/2021 |
| 9,465,336 | B2 | 10/2016 | Saito et al. | G03G 15/2053 |

(Continued)

FOREIGN PATENT DOCUMENTS

| | | | |
|---|---|---|---|
| JP | 2010002644 A | * | 1/2010 |
| JP | 2011121673 A | * | 6/2011 |

(Continued)

OTHER PUBLICATIONS

U.S. Appl. No. 17/160,062, filed Jan. 27, 2021.
U.S. Appl. No. 17/160,071, filed Jan. 27, 2021.
U.S. Appl. No. 17/326,199, filed May 20, 2021.

*Primary Examiner* — Victor Verbitsky
(74) *Attorney, Agent, or Firm* — Venable LLP

(57) ABSTRACT

A recording material cooling device includes a belt unit including a rotatable endless belt, belt stretching rollers, and a belt cooling member; a rotatable member for forming a nip between itself and the belt in contact with an outer peripheral surface of the belt and for nipping and feeding a recording material in the nip; a rotating unit capable of rotating the belt unit between a contact position where the belt and the rotatable member are in contact with each other so as to form the nip and a separated position where the belt and the rotatable member are in separation from each other so as to release the nip; and a fan unit including a fan for cooling the cooling member by generating airflow passing through the cooling member, the fan unit being rotatable together with the belt unit.

14 Claims, 9 Drawing Sheets

(56) References Cited

U.S. PATENT DOCUMENTS

| | | | | |
|---|---|---|---|---|
| 9,547,262 | B2 | 1/2017 | Hirayama et al. | G03G 15/2039 |
| 9,563,163 | B2 | 2/2017 | Tanaka et al. | G03G 15/502 |
| 9,772,585 | B2 | 9/2017 | Shimojima et al. | G03G 15/2017 |
| 10,061,242 | B2 | 8/2018 | Tanaka | G03G 15/2032 |
| 10,564,576 | B2 | 2/2020 | Tanaka et al. | G03G 15/2053 |
| 10,719,042 | B2 | 7/2020 | Hirayama et al. | G03G 15/2039 |
| 2015/0253699 | A1 | 9/2015 | Shimojima et al. | 399/94 |
| 2017/0192387 | A1 | 7/2017 | Tanaka | G03G 15/2039 |

FOREIGN PATENT DOCUMENTS

| | | | |
|---|---|---|---|
| JP | 2011123259 A | * | 6/2011 |
| JP | 2015-169705 | | 9/2015 |

* cited by examiner

RECORDING MATERIAL COOLING DEVICE, IMAGE FORMING APPARATUS AND IMAGE FORMING SYSTEM

FIELD OF THE INVENTION AND RELATED ART

The present invention relates to a recording material cooling device for cooling a recording material through a belt, and an image forming apparatus and an image forming system which include the recording material cooling device.

In an image forming apparatus, a toner image formed on the recording material is fixed on the recording material by being heated and pressed by a fixing device. For that reason, a temperature of the recording material passed through the fixing device becomes higher than a temperature of the recording material before fixing. Then, when the recording materials after the toner image fixing are discharged and stacked on a stacking portion while being high in temperature, there is a liability that the stacked recording materials stick to each other. In order to suppress such sticking of the recording materials, a recording material cooling device for lowering the temperature of the recording material after the toner image fixing is provided (Japanese Laid-Open Patent Application (JP-A) 2015-169705). The recording material cooling device disclosed in JP-A 2015-169705 is a device of a belt cooling type, in which one of a pair of endless belts for nipping and feeding the recording material passed through the fixing device is cooled by a heat sink and a temperature of the recording material is lowered through the cooled belt. The heat sink is provided inside the endless belt and contacts an inner peripheral surface of the belt.

In such a recording material cooling device, a so-called jam such that the recording material stagnates occurs in some instances. In such a case, in order to permit a user to remove the stagnating recording material, one of the pair of belts is configured so as to be separated (spaced) from the other belt. As in the device disclosed in JP-A 2015-169705, conventionally, these belts and the heat sink are assembled into a unit so that the belt cooled by the heat sink is rotatable together with the heat sink relative to the other belt (this unit is reference to as a belt unit).

Incidentally, in order to maintain cooling efficiency of the heat sink, a fan such that external air (outside air) is taken in from an outside and is capable of being exhausted so as to cause the air taken in the pass through the heat sink (this fan is referred to as a cooling fan) is provided in the recording material cooling device. Conventionally, the cooling fan has been provided at a position spaced from the belt unit by a predetermined distance so as to interfere with the rotating belt unit. That is, a predetermined interval was provided between the heat sink and the cooling fan. In the case where the predetermined interval is provided between the heat sink and the cooling fan, a path of the air (also called air passage or air flow) taken in by the cooling fan is branched, so that the air taken in passes through not only an inside of the belt unit but also an outside of the belt unit. That is, compared with an amount (in flow amount) of the air taken in from the outside, an amount (passing amount) of the air passing through the heat sink relatively decreases, so that it was hard to efficiently cool the heat sink.

SUMMARY OF THE INVENTION

The present invention has been accomplished in view of the above-described problem. A principal object of the present invention is to provide a recording material cooling device, an image forming apparatus an image forming unit, in which cooling efficient of a heat sink can be improved than in a conventional constitution in the case of a constitution in which a belt and the heat sink are provided so s to be rotatable integrally with each other and in which the heat sink is cooled by a fan.

According to an aspect of the present invention, there is provided a recording material cooling device for cooling a recording material on which a toner image is fixed by heating, the recording material cooling device comprising: a belt unit including a rotatable endless belt, a plurality of rollers for stretching the belt, and a cooling member for cooling the belt by dissipating heat in contact with an inner peripheral surface of the belt; a rotatable member configured to form a nip between itself and the belt in contact with an outer peripheral surface of the belt and configured to nip and feed the recording material in the nip; a rotating unit capable of rotating the belt unit between a contact position where the belt and the rotatable member are in contact with each other so as to form the nip and a separated position where the belt and the rotatable member are in separation from each other so as to release the nip; and a fan unit including a fan for cooling the cooling member by generating airflow passing through the cooling member, the fan unit being rotatable together with the belt unit.

Further features of the present invention will become apparent from the following description of exemplary embodiments with reference to the attached drawings.

Figure 6:
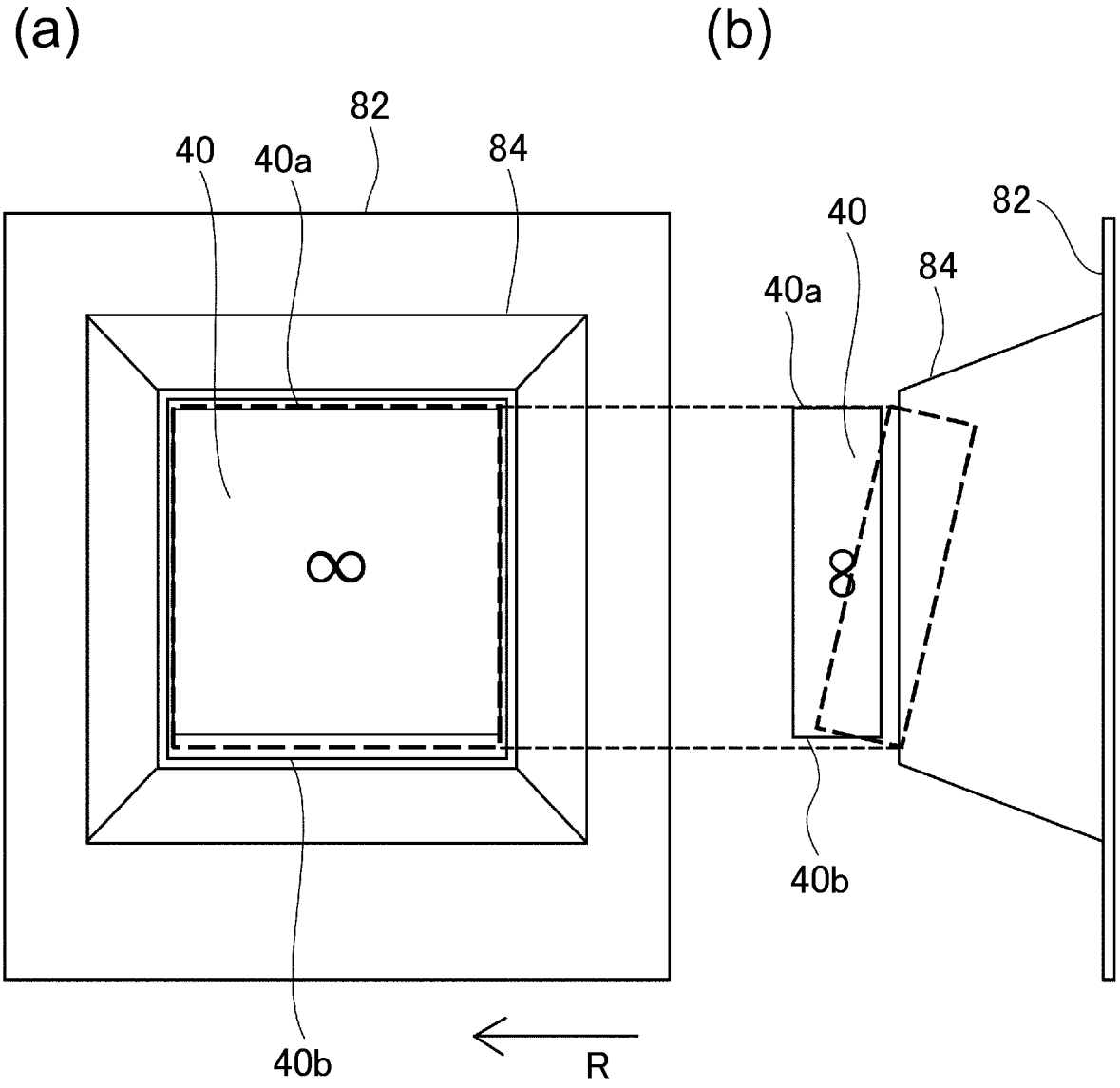

Parts (a) and (b) of FIG. 6 are schematic view for illustrating the cooling fan and a main assembly rear duct, in which part (a) shows the case where a main assembly rear side plate is viewed from a cooling fan side in a widthwise direction, and part (b) shows the case where the cooling fan and the main assembly rear side plate are viewed in a recording material feeding direction.

Figure 7:
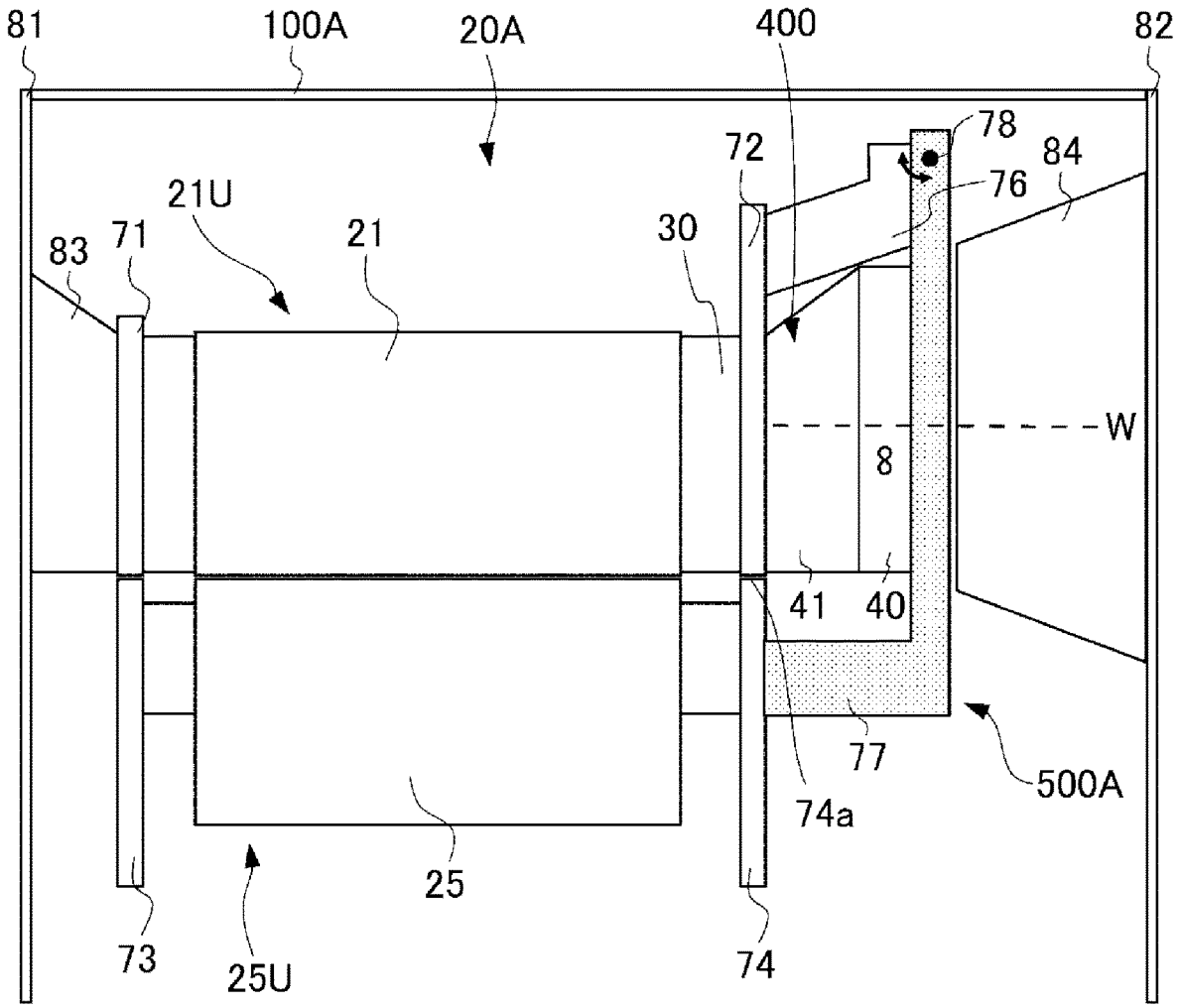

FIG. 7 is a side view showing the case where a recording material cooling device in a second embodiment is in a contact position.

Figure 8:
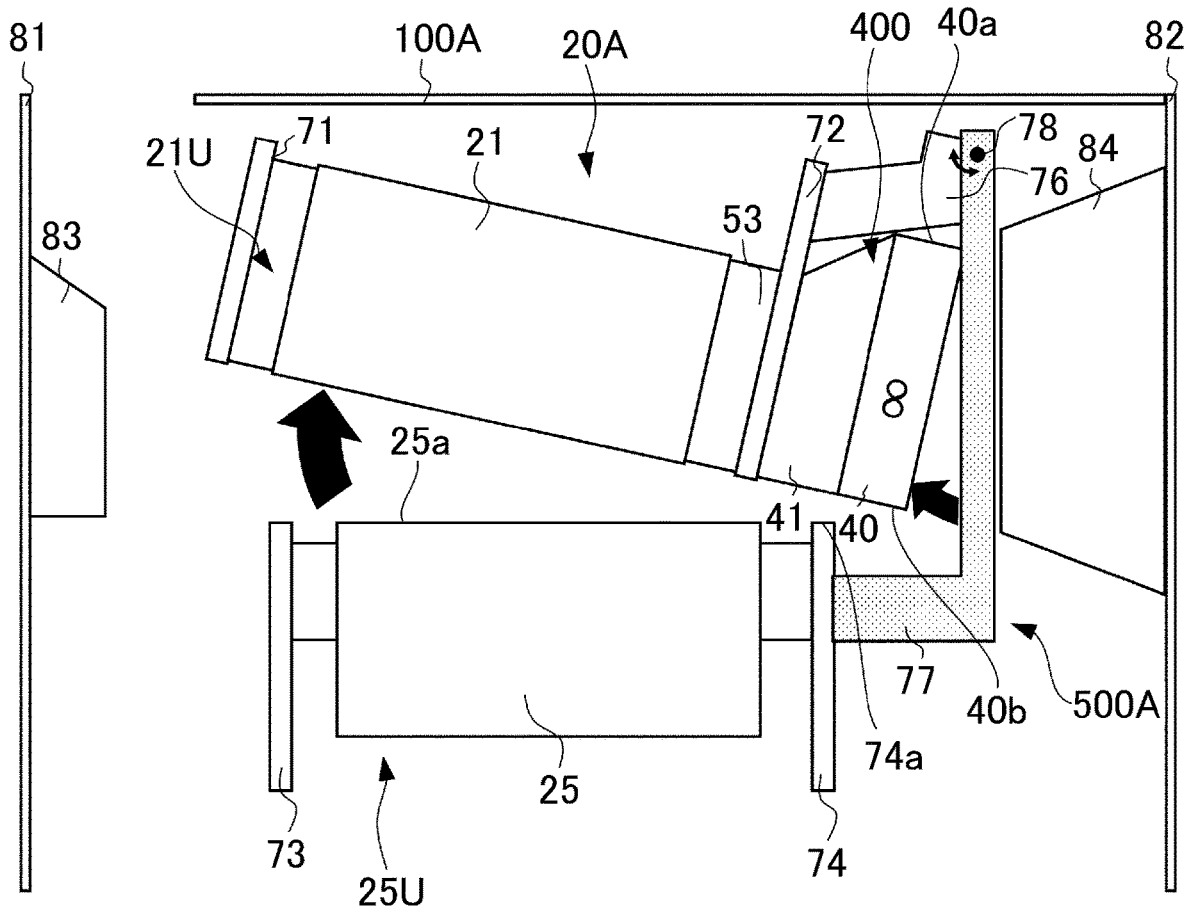

FIG. 8 is a side view showing the case where the recording material cooling device in the second embodiment is in a separated position.

Figure 9:
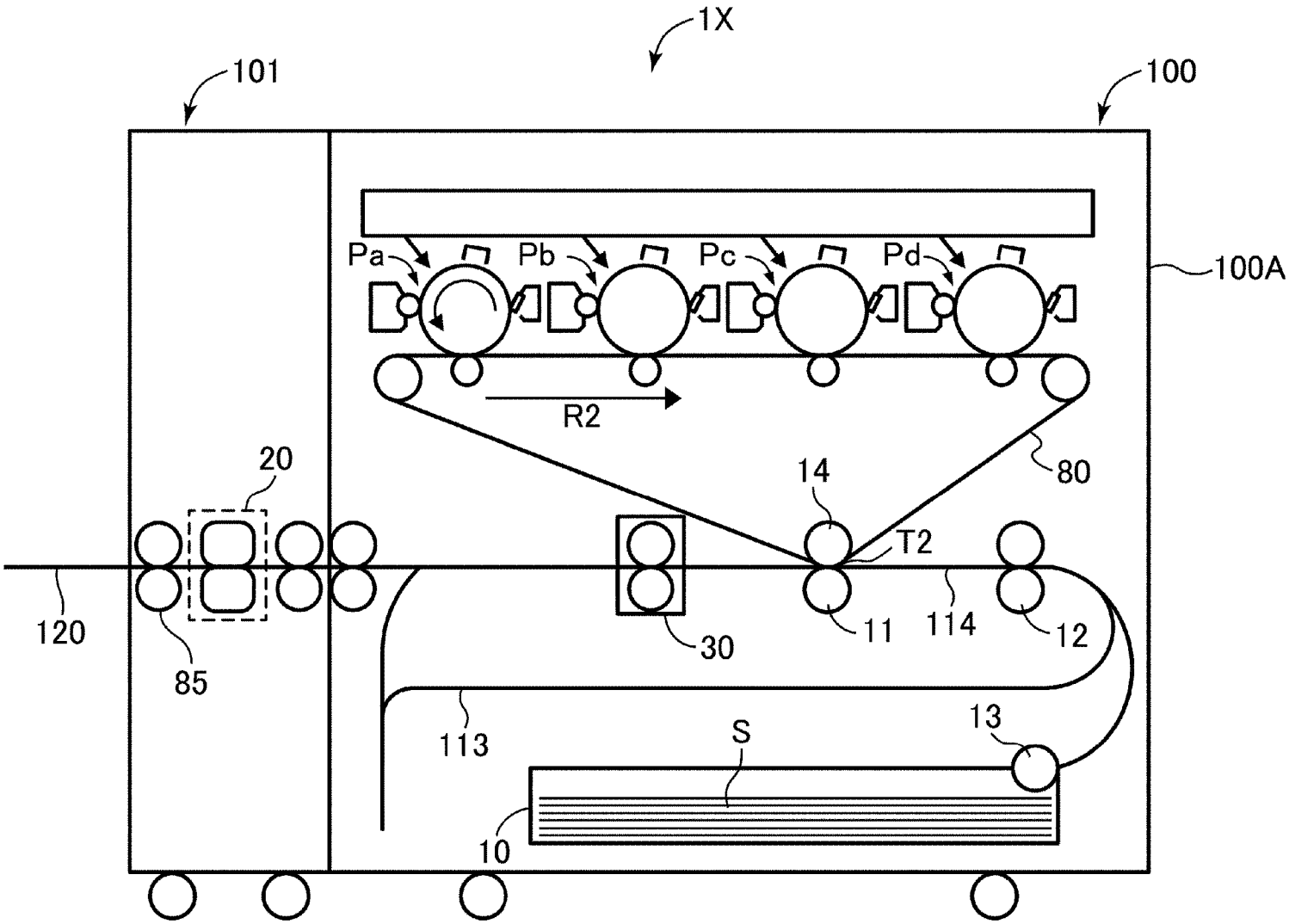

FIG. 9 is a schematic view showing an image forming system in which a recording material cooling device is device outside an image forming apparatus.

DESCRIPTION OF EMBODIMENTS

First Embodiment

<Image Forming Apparatus>

Figure 1:
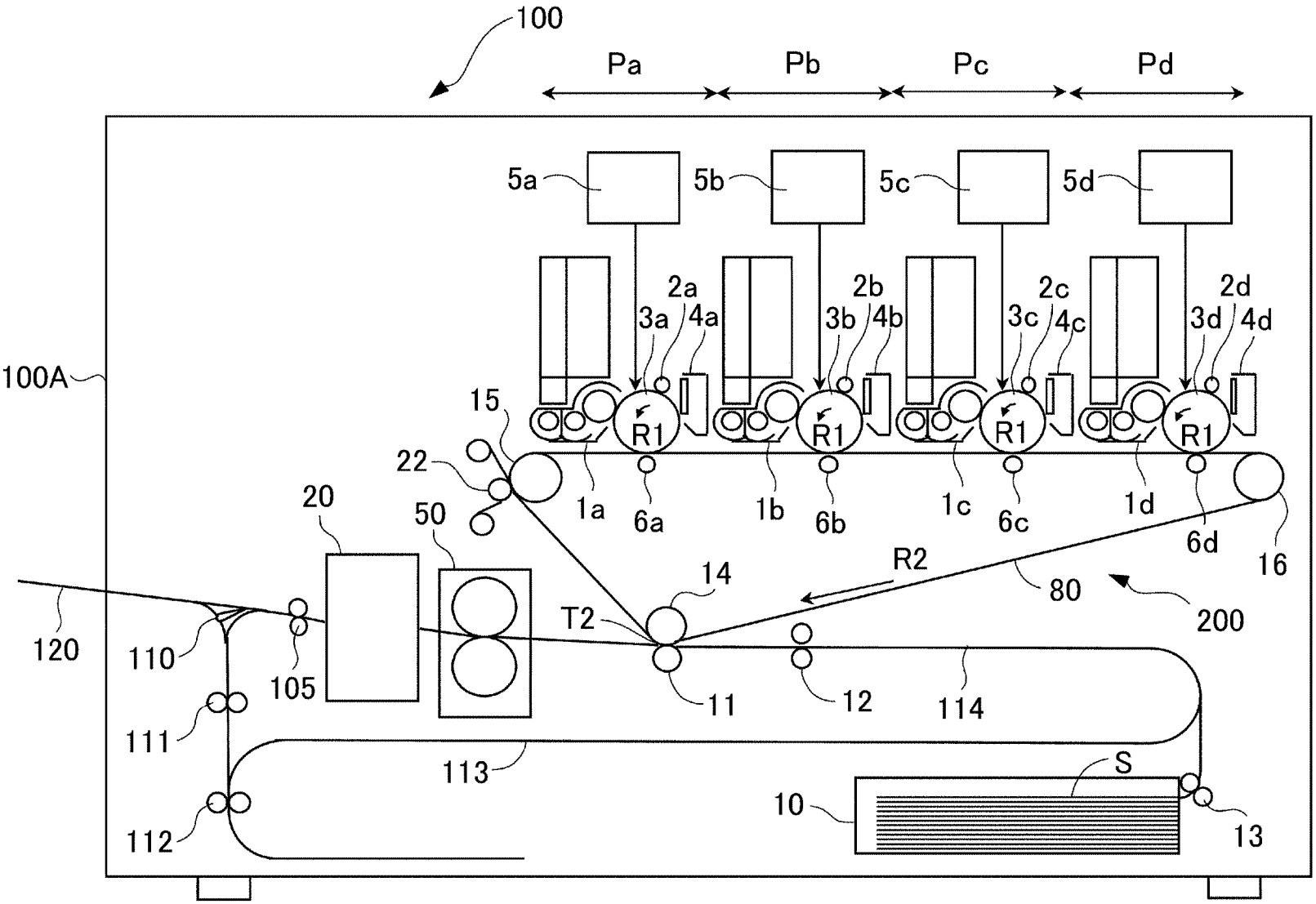
FIG. 1 is a schematic view showing a structure of an image forming apparatus according to a first embodiment.

In the following, a recording material cooling device in a first embodiment will be described. First, a general structure of an image forming apparatus suitable for use with a recording material cooling device in this embodiment will be described with reference to FIG. 1. An image forming apparatus 100 shown in FIG. 1 is an electrophotographic full-color printer of a tandem type. The image forming apparatus 100 includes image forming portions Pa, Pb, Pc and Pd for forming images of yellow, magenta, cyan and black, respectively. The image forming apparatus 100 forms a toner image on a recording material S in accordance with image information from an original reading device (not shown) for reading an image of an original or from an external device (not shown) such a personal computer communicatably connected to the image forming apparatus 100. As the recording material S, it is possible to use sheet materials of various kinds, such as sheets including plain paper, thick paper, roughened paper, uneven paper and coated paper; plastic films; and cloths. In the case of this embodiment, an image forming unit 200 for forming the toner image on the recording material S is constituted by the image forming portions Pa to Pd, primary transfer rollers 6*a* to 6*d*, an intermediary transfer belt 80, an inner secondary transfer roller 14, an outer secondary transfer roller 11, and stretching rollers 15 and 16.

A feeding process of the recording material S in the image forming apparatus 100 will be described. The recording material S is accommodated in a sheet feeding cassette 10 in a stacked form, and is sent from the sheet feeding cassette 10 in synchronism with image forming timing by a sheet feeding roller 13. The recording material S fed by the sheet feeding roller 13 is fed to a registration roller pair 12 disposed in an intermediary portion of a feeding passage 114. Then, the recording material S is subjected to oblique movement correction and timing correction by the registration roller pair 12, and thereafter is sent to a secondary transfer portion T2. The secondary transfer portion T2 is a transfer nip formed by the inner secondary transfer roller 14 and the outer secondary transfer roller 11, and the toner image is transferred onto the recording material S in response to application of a secondary transfer voltage to the outer secondary transfer roller 11.

Separately from the above-described feeding process of the recording material S to the secondary transfer portion T2, an image forming process of an image sent to the secondary transfer portion T2 at similar timing will be described. First, the image forming portions will be described, but the respective color image forming portions Pa, Pb, Pc and Pd are substantially constituted similarly except that colors of toners used in developing devices 1*a*, 1*b*, 1*c* and 1*d* are yellow, magenta, cyan and black, respectively. Therefore, in the following, as a representative example, the black image forming portion Pd is described, and other image forming portions Pa, Pb and Pc will be omitted from description.

The image forming portion Pd is principally constituted by the developing device 1*d*, a charging device 2*d*, a photosensitive drum 3*d*, a photosensitive drum cleaner 4*d*, and an exposure device 5*d* and the like. A surface of the photosensitive drum 3*d* rotated in an arrow R1 direction is electrically charged uniformly in advance by the charging device 2*d*, and thereafter, an electrostatic latent image is formed by the exposure device 5*d* driven on the basis of a signal of the image information. Then, the electrostatic latent image formed on the photosensitive drum 3*d* is developed into the toner image with a developer by the developing device 1*d*. Then, in response to application of a primary transfer voltage to a primary transfer roller 6*d* provided opposed to the image forming portion Pd through the intermediary transfer belt 80, the toner image formed on the photosensitive drum 3*d* is primary-transferred onto the intermediary transfer belt 80. Primary transfer residual toner slightly remaining on the photosensitive drum 3*d* is collected by the photosensitive drum cleaner 4*d*.

The intermediary transfer belt 80 is stretched by the inner secondary transfer roller 14 and the stretching rollers 15 and 16, and is driven in an arrow R2 direction in FIG. 1. In the case of this embodiment, the stretching roller 16 also functions as a driving roller for driving the intermediary transfer belt 80. The respective color image forming processes performed in parallel by the image forming portions Pa to Pd are carried out at timings each when the toner image is superposed onto the toner image, of an upstream color, which is primary-transferred on the intermediary transfer belt 80. As a result, consequently, a full-color toner image is formed on the intermediary transfer belt 80 and is fed to the secondary transfer portion T2. Incidentally, secondary transfer residual toner passed through the secondary transfer portion T2 is removed from the intermediary transfer belt 80 by a transfer cleaner 22.

As described above, by the feeding process and the image forming process which are described above, the timing of the recording material S and the timing of the full-color toner image coincide with each other at the secondary transfer portion T2, so that secondary transfer is carried out. Thereafter, the recording material S is fed to a fixing device 50, in which predetermined pressure and predetermined heat quantity are applied, so that the toner image is fixed on the recording material S. The fixing device 50 nips and feeds the recording material S on which the toner image is formed and thus heats and presses the fed recording material S, so that the toner image is fixed on the recording material S. That is, the toners for the full-color toner image formed on the recording material S are melted and mixed by heating and pressing, and are fixed as a full-color image on the recording material S. Thus, a series of operations of the image forming process is ended. Further, in the case of this embodiment, the recording material S on which the toner image is fixed is fed from the fixing device 50 toward a recording material cooling device 20, and is then cooled. For example, a temperature of the recording material S is about 90° C. immediately in front of the recording material cooling device 20, but is lowered to about 60° C. after the recording material S passes through the recording material cooling device 20.

In the case of one-side image formation, the recording material S cooled by the recording material cooling device 20 is fed by a pair of discharging rollers 105 and is discharged onto a discharge tray 120 as it is. On the other hand, in the case of double-side image formation, by a switching member 110 (which is called a flapper or the like), a sheet feeding passage is switched from a passage continuous toward the sheet discharge tray 120 to a passage continuous to a double-side leading roller pair 111, so that the recording material S nipped and fed by the discharging roller pair 105 is sent toward the double-side leading roller pair 111. Thereafter, a leading end and a trailing end of the recording material S are changed to each other by a reversing roller pair 112 and is sent to the feeding passage 114 again through a double-side passage 113. As regards subsequent feeding process and an image forming process of the image on a back surface (second surface) of the recording material S, these processes are similar to those described above, and therefore, will be omitted from description.

<Recording Material Cooling Device>

Figure 2:
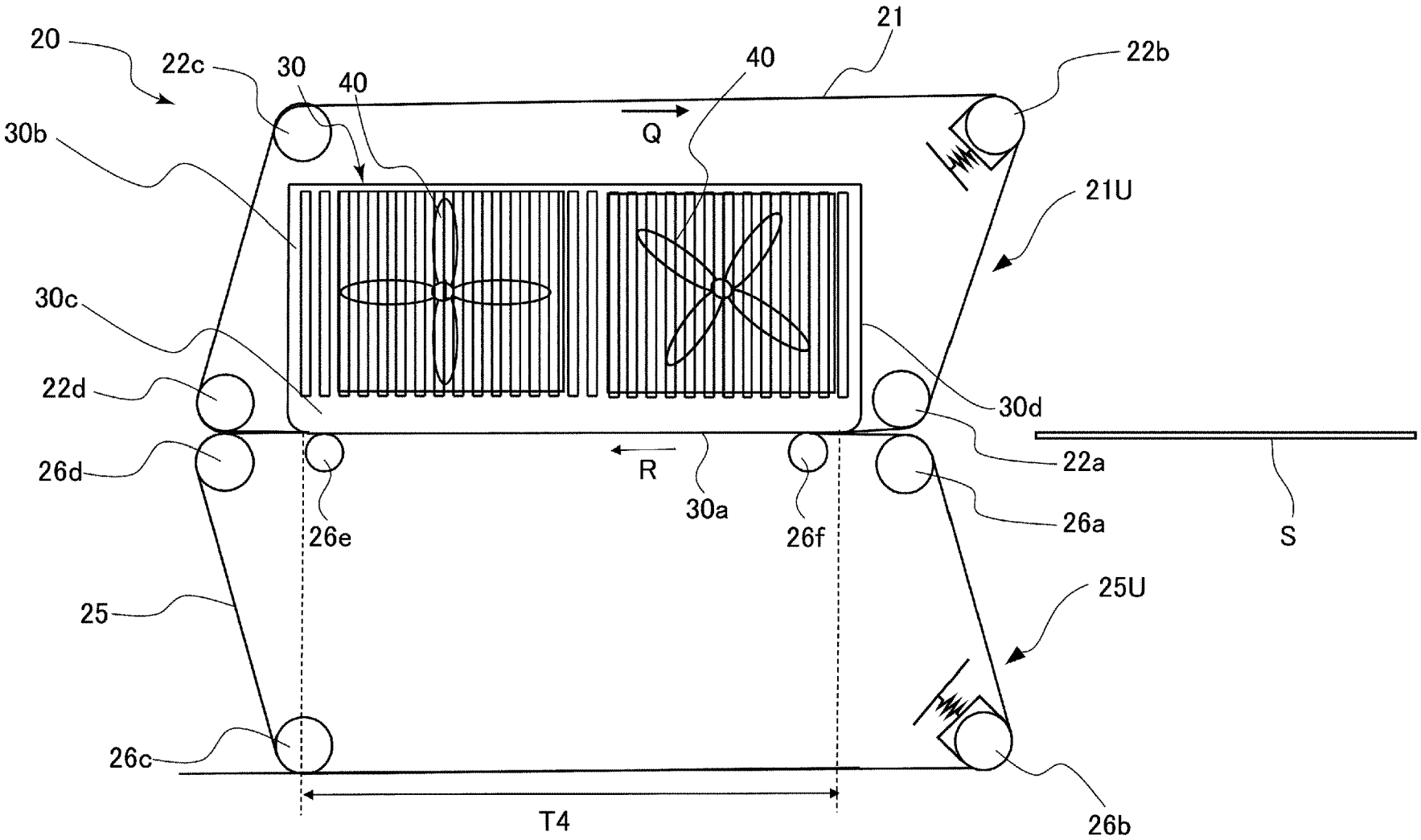
FIG. 2 is a front view showing a structure of a recording material cooling device in the first embodiment.

Next, an outline of the recording material cooling device 20 will be described using FIGS. 2 to 7. The recording material cooling device 20 described in this embodiment is a recording material cooling device of a belt cooling type. As shown in FIG. 2, the recording material cooling device 20 includes a first unit 21U and a second unit 25U. The first unit 21U as a belt unit includes a first endless belt (first belt) 21, a plurality of first belt stretching rollers 22*a* to 22*d*, and a heat sink 30. On the other hand, the second unit 25U includes a second endless belt (second belt) 25, a plurality of second belt stretching rollers 26*a* to 26*d*, and pressing rollers 26*e* and 26*f*. Each of the first belt 21 and the second belt 25 is a film-like endless belt formed with a polyimide resin material high in strength, for example.

In the first unit 21U, the first belt 21 is stretched by the first belt stretching rollers 22*a* to 22*d*, and at least either one of the first belt stretching rollers 22*a* to 22*d* is rotated by a driving motor (not shown). For example, the roller 22*d* is rotated by the driving motor, so that the first belt 21 is moved in an arrow Q direction. The roller 22*d* as a driving roller includes for example, a 1 mm-thick rubber layer as a surface layer and is formed in an outer diameter φ of 40 mm.

The roller 22*b* is a steering roller such that it contacts an inner peripheral surface of the first belt 21 and is capable of stretching the first belt 21 in cooperation with the roller 22*c* and that it controls a shift of the first belt 21 in a widthwise direction (rotational axis direction of the roller 22*c*). The roller 22*b* includes a 1 mm-thick rubber layer as a surface layer and is subjected to steering control such that a rudder angle is provided relative to the roller 22*c* as a first roller, whereby the roller 22*b* is capable of controlling meandering of the first belt 21.

Further, inside the first belt 21, in addition to the first belt stretching rollers 22*a* to 22*d*, the heat sink 30 is provided. Opposite end portions of a rotation shaft of each of the first belt stretching rollers 22*a* to 22*d* are shaft-supported rotatably by a pair of a front side plate 71 and a rear side plate 72 (FIG. 3 described later) which are provided with an interval with respect to the widthwise direction in the first unit 21U. Further, the heat sink 30 is fixed to and held by the first front side plate (first holding plate) 71 and the rear side plate (second holding plate) 72 so as to contact the inner peripheral surface of the first belt 21. Each of the front side plate 71 and the rear side plate 72 is formed of, for example, a mental plate with high rigidity.

The recording material S on which the toner image is fixed is nipped between the first belt 21 and the second belt 25 and is fed in a recording material feeding direction (arrow R direction in the figure) by rotation of these belts. During the feeding, the recording material S passes through a cooling nip T4 as a nip formed by contact of the first belt 21 and the second belt 25. Further, the first belt 21 of the belts forming the cooling nip T4 is cooled by the heat sink 30. In order to efficiently cool the recording material S, the heat sink 30 is disposed so as to contact the inner peripheral surface of the first belt 21 at a place where the cooling nip T4 is formed. A temperature of the recording material S is lowered through the first belt 21 cooled by the heat sink 30 when the recording material S passes through the cooling nip T4. Incidentally, the above-described widthwise direction of the first belt 21 is a direction perpendicular to the sheet feeding direction and a vertical direction in the cooling nip T4.

The heat sink 30 as a cooling member is radiator (dissipater) plate formed of metal such as aluminum. The heat sink 30 includes a heat receiving portion 30*a* for taking heat from the first belt 21 in contact with the first belt 21, a heat radiating (dissipating) portion 30*b* for radiating (dissipating) heat, and a fin base 30*c* for transferring the heat from the heat receiving portion 30*a* to the heat radiating portion 30*b*. The heat radiating portion 30*b* is formed with many heat radiating fins in order to promote efficient radiation by increasing a contact area to the air taken in from an outside of a cooling fan 40. For example, the heat radiating fins are set at 1 mm in thickness, 100 mm in height and 5 mm in pitch, and the fin base 30*c* is set at 10 mm in thickness.

On the other hand, in the second unit 25U, the second belt 25 as a rotatable member is stretched by the plurality of second belt stretching rollers 26*a* to 26*d* and is contacted to another peripheral surface of the first belt 21. Opposite end portions of a rotation shaft of each of the second belt stretching rollers 26*a* to 26*d* are shaft-supported rotatably by a pair of a front side plate 73 and a rear side plate 74 (FIG. 3) which are provided with an interval with respect to the widthwise direction in the second unit 25U. Each of the front side plate 73 and the rear side plate 74 of the second unit 25U is formed of a metal plate with high rigidity similarly as in the case of the front side plate 71 and the rear side plate 72 of the first unit 21U. The recording material cooling device 20 is mounted in an apparatus main assembly 100A by fixing the front side plate 73 and the rear side plate 74 to a supporting frame or the like as the apparatus main assembly 100A of the image forming apparatus 100. In the case of this embodiment, in a mounted state of the recording material cooling device 20, the first unit 21U is moved relative to the apparatus main assembly 100A, while the second unit 25U is not moved relative to the apparatus main assembly 100A. Here, the apparatus main assembly 100A refers to the supporting frame for supporting respective units provided inside the image forming apparatus 100 and on which an outer cover or the like constituting an outer appearance of the image forming apparatus 100 is mounted.

The above-described first belt 21 and second belt 22 are in contact with each other, so that the cooling nip T4 in which the recording material S on which the toner image is formed is cooled while being nipped and fed is formed. The roller 26*d* is connected to a driving motor for driving the roller 22*d* through a driving gear although these driving motor and driving gear are omitted from illustration in FIG. 2, and to the driving gear, a rotational driving force of the driving motor is transmitted, so that the second belt 25 is rotated in an arrow R direction. Thus, the second belt 25 rotates together with the first belt 21. Further, the roller 26*b* is a steering roller for controlling a shift of the second belt 25 with respect to the widthwise direction and performs a steering operation such that a rudder angle relative to the roller 26*c* is provided with a central portion, with respect to the widthwise direction, as a rotation center, and thus controls meandering of the second belt 25.

Inside the second belt 25, the plurality of pressing rollers 26*e* and 26*f* are provided for pressing the second belt 25 toward the heat sink 30 provided inside the first belt 21. In this embodiment, as an example, with respect to the recording material feeding direction (arrow R direction), the pressing roller 26*e* is provided on a side upstream of the cooling nip T4, and the pressing roller 26*f* is provided on a side downstream of the cooling nip T4. These pressing rollers 26*e* and 26*f* press the second belt 25 at pressure (pressing force) of, for example, 4.9 N (0.5 kgf), so that the first belt 21 is contacted to the heat sink 30 with reliability by the second belt 25. Incidentally, opposite end portions of each of rotation shafts of the pressing rollers 26*e* and 26*f* are rotatably shaft-supported by the front side plate 73 and the rear side plate 74 (FIG. 3) of the second unit 25U similarly as in the case of the second belt stretching rollers 26*a* to 26*d*.

Incidentally, in this embodiment, an example in which both the first belt 21 and the second belt 25 are driven was described, but the present invention is not limited thereto. For example, a constitution in which only the first belt 21 is driven and the second belt 25 is driven by the first belt 21 may also be employed, or a constitution in which only the second belt 25 is driven and the first belt 21 is driven by the second belt 25 may also be employed. Further, a constitution in which a roller (rotatable member) is used in place of the second belt 25 and is contacted to the first belt 21 and thus forms the cooling nip T4 may also be employed.

Figure 3:
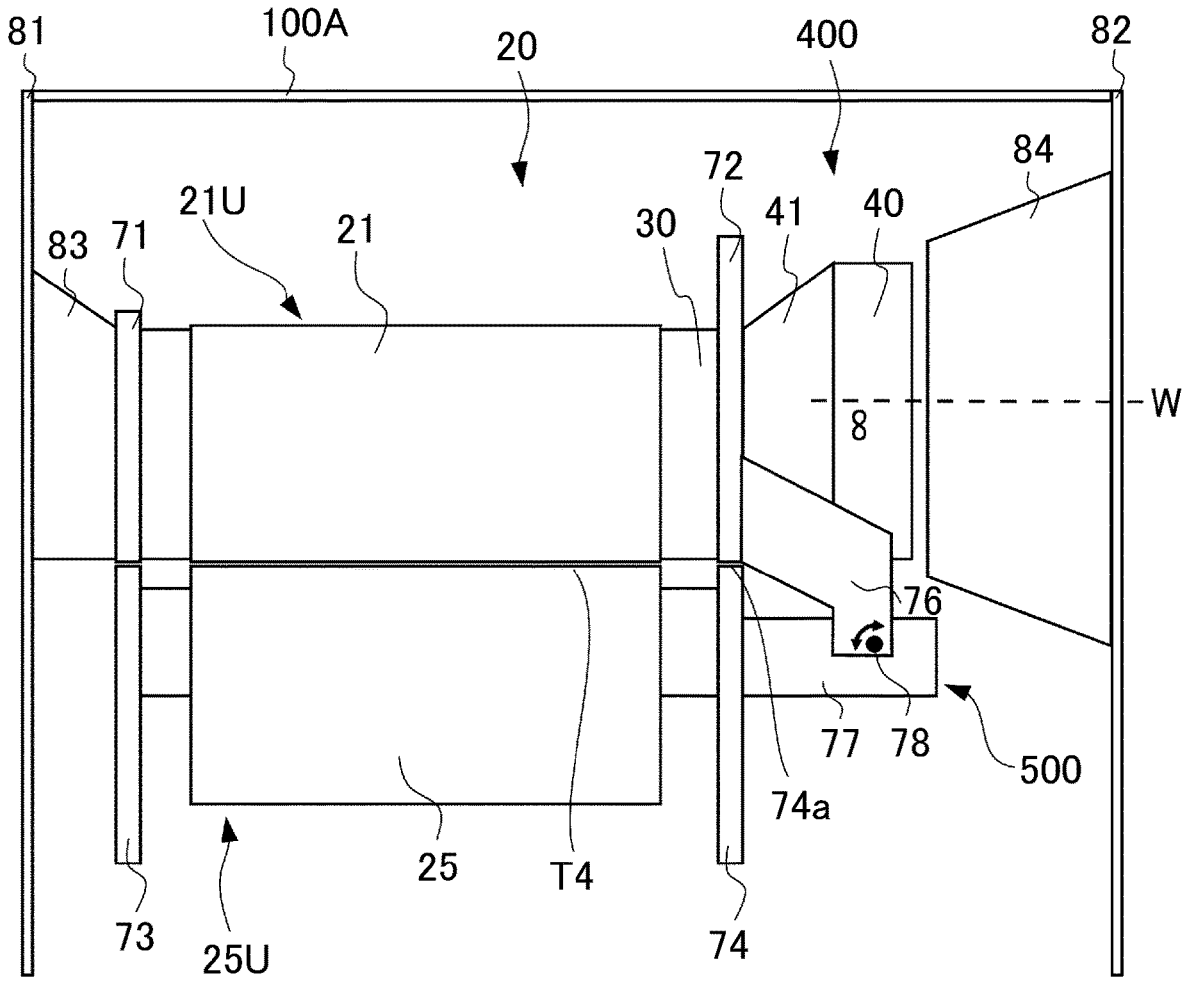
FIG. 3 is a side view showing the case where the recording material cooling device in the first embodiment is in a contact position.
Figure 4:
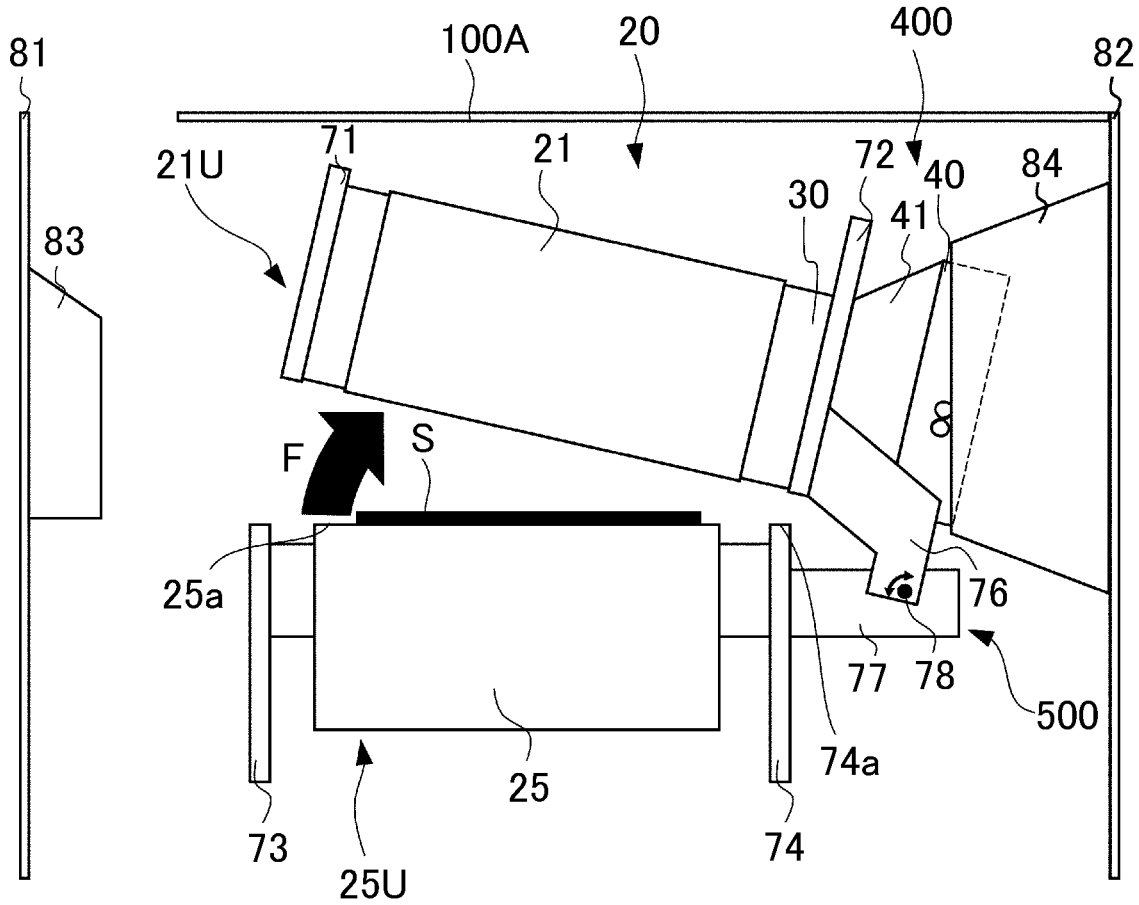
FIG. 4 is a side view showing the case where the recording material cooling device in the first embodiment is in a separated position.

The first unit 21U and the second unit 25 are vertically disposed with respect to the direction of gravitation, and the first unit 21U including the heat sink 30 is provided so as to be vertically rotatable relative to the second unit 25U. In this embodiment, a structure in which a rotation supporting point is provided on the rear side plate 72 side and the front side plate 71 side is vertically rotated is described as an example. The first unit 21U is movable relative to the second unit 25 between a contact position where the first belt 21 is contacted to the second belt 25 (FIG. 3) and a separated position where the first belt 21 is separated (spaced) from the second belt 25 (FIG. 4). This is because in the case where a so-called jam such that the recording material S stagnates in the recording material cooling device 20 occurs, a user separates the first belt 21 from the second belt 25 and can remove the recording material S nipped in the cooling nip T4. Incidentally, in order to permit the user to manually perform contact and separation between the first belt 21 and the second belt 25, an openable front door 81 (FIGS. 3 and 4) is provided on the apparatus main assembly 100A. In the case where the jam occurs in the recording material cooling device 20, the user opens the front door 81 and thus has access to the recording material cooling device 20. Incidentally, in the case where a side surface where the front door 81 is provided in the image forming apparatus 100 is a front surface of the image forming apparatus 100, the above-described widthwise direction is the same as a front-rear direction of the image forming apparatus 100.

Incidentally, in the recording material cooling device 20 of the belt cooling type, in order to maintain cooling efficiency of the heat sink 30 with temperature rise due to use, the air is taken in from the outside to the inside of the apparatus main assembly 100A and is passed through the heat sink 30, so that the heat sink 30 may be cooled. Therefore, conventionally, the cooling fan 40 for cooling the heat sink 30 is provided as shown in FIG. 2. However, as has already been described above, in the conventional device, the cooling fan 40 was provided on the apparatus main assembly 100A side by being separated from the first unit 21U so as not to rotate integrally with the rotatable first unit 21U and so as not to interfere with the first unit 21U.

In the case of the conventional device, as described above, between the cooling fan 40 and the first unit 21U, there is a need to ensure a predetermined interval in order to prevent the first unit 21 from interfering with the cooling fan 40 when the first unit 21 is rotated. Therefore, a path of the air (called air passage or air flow) taken in by the cooling fan 40 is branched in the apparatus main assembly 100A, and the air passes not only the inside of the first unit 21U (specifically the first belt 21) but also the outside of the first unit 21U. That is, in the case where there is a gap in which the air can enter the cooling fan 40 side, due to a characteristic of the cooling fan 40, in flow of the air from the outside of the first unit 21U small in pressure loss increases compared with the inside of the first unit 21U large in pressure loss by the heat sink 30. As a result, an amount of the air passing through the heat sink 30 becomes relatively small, so that cooling efficiency of the heat sink 30 can lower.

Thus, conventionally, compared with an amount (inlet (amount)) of the air taken in the apparatus main assembly 100A by the cooling fan 40, an amount (passing amount) of the air passing through the heat sink 30 in the first unit 21U relatively decreases, so that it was hard to cool the heat sink 30 efficiently.

Figure 5:
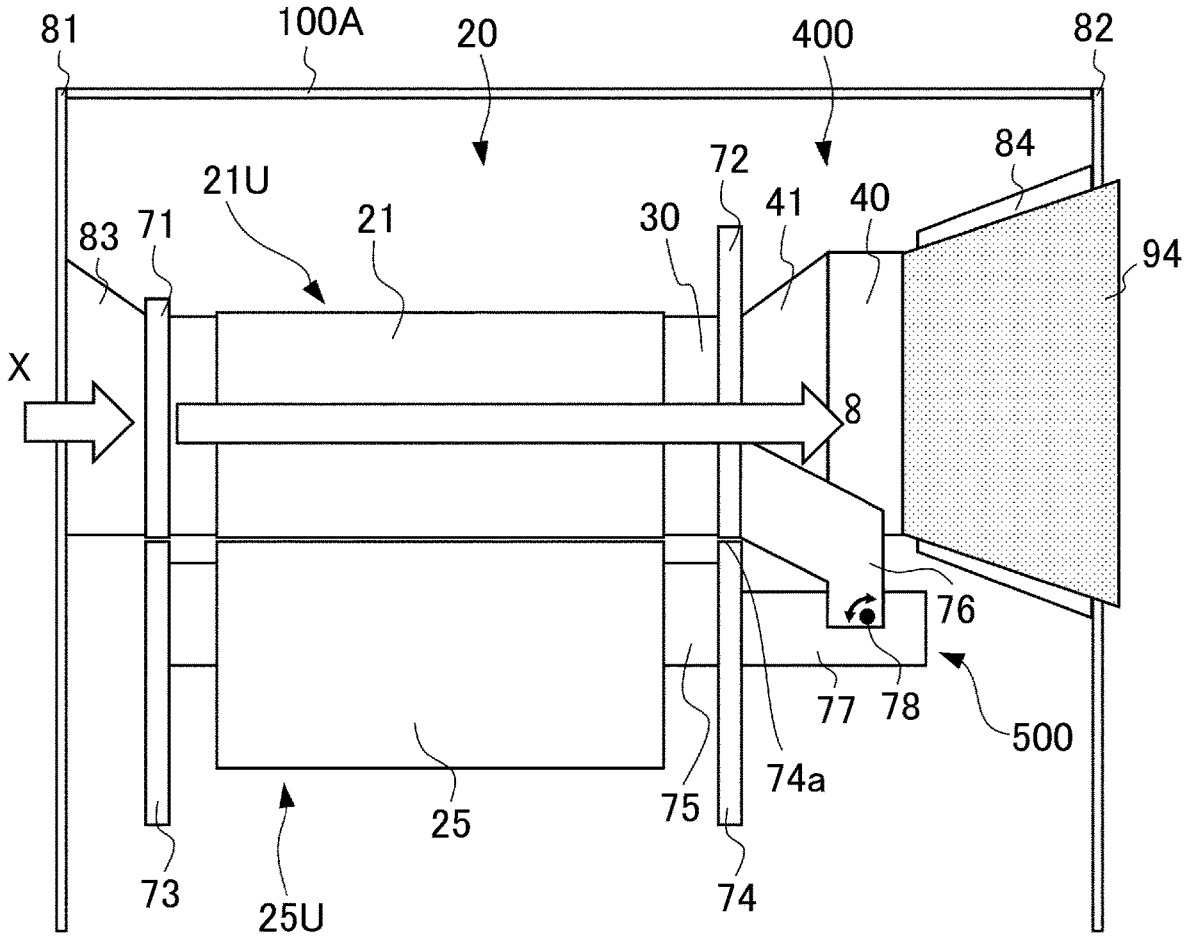
FIG. 5 is a side view for illustrating air flow generated by a cooling fan.

In view of the above-described points, in the recording material cooling device 20 in this embodiment, improvement in cooling efficiency of the heat sink 30 by the cooling fan 40 can be realized by a simple constitution. In the following, description will be made with reference to FIGS. 3 to 6 while making reference to FIG. 2. Incidentally, FIGS. 3 and 5 show the case where the first unit 21U is in the contact position where the first belt 21 and the second belt 25 are in contact with each other in a state in which the front door 81 is closed. FIG. 4 shows the case where the first unit 21U is in the separated position where the first belt 21 and the second belt 25 are in separation from each other in a state in which the front door 81 is open.

As shown in FIGS. 3 and 4, the recording material cooling device 20 in this embodiment includes a fan unit 400 and a rotating mechanism portion 500 in addition to the first unit 21U and the second unit 25U which are described above. The first unit 21U is provided with the pair of the front side plate 71 and the rear side plate 72, and the second unit 25U is provided with the pair of the front side plate 73 and the rear side plate 74. As described above, by the front side plate 71 and the rear side plate 72, not only the first belt stretching rollers 22*a* to 22*d* are shaft-supported but also the heat sink 30 is supported, and by the front side plate 73 and the rear side plate 74, the second belt stretching rollers 26*a* to 26*d* and the pressing rollers 26*e* and 26*f* are supported. Each of the pair of the front side plate 71 and the rear side plate 72 and the pair of the front side plate 73 and the rear side plate 74 is provided with an air flow opening through which the air passes.

<Fan Unit>

The fan unit 400 is mounted to the first unit 21U so as to rotate integrally with the first unit 21U. The fan unit 400 includes the cooling fan 40 and a fan duct 41. The fan duct 41 is provided with an air inlet opening with a size substantially equal to a size of an opening formed in the rear side plate 72 in order to form air flow and is provided with an air discharge (exhaust) opening substantially equal to the air inlet opening of the cooling fan 40. By this constitution, the fan duct 41 is disposed between the rear side plate 72 of the first unit 21U and the cooling fan 40. Further, the fan duct 41 connects the first unit 21U and the cooling fan 40 with no gap, and thus forms a sealed air dust, in which no leakage of the air occurs, from the air discharge opening of the rear side plate 72 to the air inlet opening of the fan duct 41. The cooling fan 40 is, for example, an air discharge fan capable of taking the air in the first unit 21U from the outside of the apparatus main assembly 100A and capable of discharging the air. As shown in FIG. 5, when the cooling fan 40 operates, the air is taken in the apparatus main assembly 100A from the outside, and the air taken in causes air flow (arrow X) passing through the inside of the first unit 21U and reaches the fan duct 41. Incidentally, in this embodiment, the state in which there is no gap between the fan duct 41 and the cooling fan 40 also includes a state in which a minute gap generates due to a component (part) tolerance or the like.

In order to enhance the cooling efficiency of the heat sink 30, it is desirable that the temperature of the air passed through the inside of the first unit 21U is a low temperature to the extent possible. Therefore, the air outside the apparatus main assembly 100A is taken in without taking the air inside the apparatus main assembly 100A increased in temperature by the influence of heat by another unit (FIG. 1) such as the fixing device 50 disposed in the apparatus main assembly 100A. Specifically, the openable front door 81 is provided an inlet opening for taking the air in the first unit 21, and on an inner surface of the front door 81, a main assembly front duct 83 is provided. The main assembly front duct 83 is contactable to and separable from the front side plate 71, and is connected to the first unit 21U in a state in which the front door 81 is closed, and thus forms an air duct through which the air flows from the outside of the apparatus main assembly 100A to the inside of the first unit 21U. In other words, the main assembly front duct 83 forms an air duct for guiding the air, taken in through the inlet opening of the front door 81 by the cooling fan 40, to the inside of the first unit 21U.

The air guided to the inside of the first unit 21U cools the heat sink 30 when the passes through the inside of the first unit 21U. Further, in order to prevent stagnation of the air, increased in temperature with cooling of the heat sink 30, in the apparatus main assembly 100A, the air is discharged by the cooling fan 40 to the outside through the air discharge opening provided in the main assembly rear side plate 82. Further, in order to suppress that the air increased in temperature is diffused in the apparatus main assembly 100A, the main assembly main assembly rear side plate 82 is provided with the main assembly rear duct 84. The air immediately after being discharged by the cooling fan 40 is diffused in the form such that a downstream portion of the air flow spreads out than an upstream portion of the air flow spreads out as shown as a diffusion range 94 in FIG. 5. For this reason, the main assembly rear duct 84 of the apparatus main assembly 100A is provided with an air opening which opens in a degree larger than the diffusion range 94.

In this embodiment, in order to efficiency cool the heat sink 30, the main assembly front duct 83, the first unit 21U, the fan unit 400 and the main assembly rear duct 84 are arranged in the line with respect to the widthwise direction. That is, the main assembly front duct 83, the first unit 21U, the fan unit 400 and the main assembly rear duct 84 are disposed so as to overlap with each other as viewed in a direction (widthwise direction) crossing the recording material feeding direction.

<Rotating Mechanism>

The recording material cooling device 20 in this embodiment includes the rotating mechanism portion 500 so that the first unit 21U including the heat sink 30 is rotatable upward relative to the second unit 25U which does not include the heat sink 30. As shown in FIGS. 3 and 4, the rotating mechanism portion 500 is provided with a rotation shaft 78 (rotation supporting point) on the main assembly rear side plate 82 side and rotates the first unit 21U so that the front side plate 71 side of the first unit 21U moves upward and downward. As described above, the fan unit 400 is provided integrally with the first unit 21U, and therefore, the rotating mechanism portion 500 rotates the first unit 21U so that the fan unit 400 (specifically the cooling fan 40) does not interfere with the main assembly rear duct 84.

The rotating mechanism portion 500 as a rotating means is, for example, a hinge including a first rotation supporting member 76 and a second rotation supporting member 77 which function as a rotation supporting member and including the rotation shaft 78. In this embodiment, two rotating mechanism portions 500 are provided so as to sandwich the fan unit 400 with respect to the recording material feeding direction. The first rotation supporting member 76 projects from the rear side plate 72 of the first unit 21U toward the main assembly rear side plate 82 side so as not to interfere with the fan unit 400, i.e., the fan duct 41 and the cooling fan 40. On the other hand, the second rotation supporting member 77 projects from the rear side plate 74 of the second unit 25U toward the main assembly rear side plate 82 side. These first rotation supporting member 76 and second rotation supporting member 77 are connected by the rotation shaft 78 disposed on a side closer to the main assembly rear side plate 82 side than the rear side plate 72 of the first unit 21U is. The rotation shaft 78 may preferably be disposed between the (air) inlet opening and the (air) discharge opening of the cooling fan 40 with respect to the widthwise direction as shown in FIG. 3, for example.

The first rotation supporting member 76 is provided so as to be rotatable relative to the second rotation supporting member 77 about the rotation shaft 78 as a rotation center, so that as shown in FIG. 4, the first unit 21U and the fan unit 400 are capable of being rotated integrally with each other relative to the second unit 25U fixed to the apparatus main assembly 100A. Further, in this embodiment, a constitution in which the first unit 21U is rotated is employed, so that there is no need to provide a predetermined interval corresponding to a rotation locus of the second unit 25U between the first unit 21U and the cooling fan 40. By this, the cooling fan 40 and the first unit 21U can be brought nearer to each other than in the conventional constitution, and therefore, a path of the air taken in by the cooling fan 40 is not branched, so that the air taken in passes through the inside of the first unit 21U. That is, most of the air taken in by the cooling fan 40 is capable of passing through the heat sink 30, so that the heat sink 30 is cooled efficiently. Further, the cooling fan 40 can be brought near to the heat sink 30 to the extent possible, so that cooling efficiency of the heat sink 30 is easily improved. Incidentally, in this embodiment, a constitution in which the cooling fan 40 and the fan duct 41 are always provided integrally with each other is described, but a constitution in which there is no gap between the cooling fan 40 and the fan duct 41 in the case where the first unit 21U is in the contact position may only be required to be employed. That is, a constitution in which a gap is formed between the cooling fan 40 and the fan duct 41 in the case where the first unit 21U is in the separated position may also be employed. For example, a constitution in which the cooling fan 40 is rotated relative to the first unit 21U by using a rotation center different from the rotation center of the rotating mechanism portion 500 and in which the cooling fan 40 is rotated relative to the fan duct 41 with rotation of the first unit 21U from the contact position toward the separated position may also be employed. In this case, a state in which there is no gap between the cooling fan 40 and the fan duct 41 can be maintained by urging or the like the cooling fan 40 so as to contact the fan duct 41 in a state in which the first unit 21U is in the contact position.

Further, in the case of this embodiment, the rotation shaft 78 is disposed below a horizontal (rectilinear) line W passing through a center of the cooling fan 40 with respect to the direction of gravitation as shown in FIG. 3. Here, the center of the cooling fan 40 with respect to the direction of gravitation is a rotation center of the cooling fan 40. In this case, with rotation of the first unit 21U, the fan unit 400 is rotated in a direction in which the fan unit 400 approaches the rear duct 84 of the apparatus main assembly 100A, so that a part of the cooling fan 40 enters the rear duct 84.

In part (a) and (b) of FIG. 6, a positional relationship between the cooling fan 40 and the rear duct 84 of the apparatus main assembly 100A is shown. Part (a) of FIG. 6 shows the case where the main assembly rear side plate 82 side is viewed from the cooling fan 40 side with respect to the widthwise direction, and part (b) of FIG. 6 shows a position of the cooling fan 40 relative to the rear duct 84 of the apparatus main assembly 100A as viewed in the widthwise direction. As the position of the cooling fan 40, a state in which the first unit 21 is in the contact position (FIG. 3) is represented by a solid line, and a state in which the first unit 21U is in the separated position (FIG. 4) is represented by a broken line.

As described above, with rotation of the first unit 21U, the cooling fan 40 is rotated together with the first unit 21U, so that the part of the cooling fan 40 enters the rear duct 84 of the apparatus main assembly 100A. In the case of this embodiment, as shown in part (a) of FIG. 6, the cooling fan 40 is rotated so that a projected area (plane) with respect to an up-down direction becomes large. The above-described rotating mechanism portion 500 is formed so that such a projected area is provided. Further, the inlet opening of the main assembly rear duct 84 is formed in a size including such a projected area. On the other hand, the cooling fan 40 is not rotated in the recording material feeding direction (arrow R direction) during rotation thereof. For that reason, the inlet opening of the main assembly rear duct 84 is formed so that a gap between itself and the cooling fan 40 with respect to the recording material feeding direction is minimized. Thus, in this embodiment, by providing the above-described rotating mechanism portion 500, the cooling fan 40 and the main assembly rear duct 84 can be brought near to each other, so that the cooling efficiency of the heat sink 30 can be improved.

Further, in this embodiment, as shown in part (b) of FIG. 6, during rotation of the first unit 2U, an upper end portion 40*a* of the cooling fan 40 moves in the widthwise direction in an amount large than a lower portion 40*b* of the cooling fan 40 moves, so that the part of the cooling fan 40 enters the main assembly rear duct 84. In order to do so, as described above, the rotation shaft 78 is disposed below the horizontal line W passing through the center of the cooling fan 40 with respect to the direction of gravitation (FIG. 3). However, a locating position of this rotation shaft 78 is determined also in view of such a point that a rotation mode of the first unit 21U changes depending on a distance from the rotation shaft 78 to the upper end portion 74*a* of the rear side plate 74 and has the influence on a degree of ease of removal of the recording material S by the user. In this embodiment, as shown in FIG. 3, the rotation shaft 78 is disposed below the upper end portion 74*a* of the rear side plate 74 of the second unit 25U as shown in FIG. 3.

Further, in the above-described arrangement of the rotation shaft 78, as shown in FIG. 4, the cooling fan 40 does not protrude toward a side below an upper end surface 25*a* of the second belt 25 supporting the recording material S from below. For that reason, in order to remove the stagnated recording material S, when the first unit 21U is rotated, the stagnated recording material S is not pressed by the cooling fan 40. Accordingly, even when the user rotates the first unit 21U, the user is easy to remove the recording material S without breaking the stagnated recording material S.

As described above, in this embodiment, the cooling fan 40 is mounted to the rotatable first unit 21U via the fan duct 41, so that in the case where the first unit 21U is rotated, the cooling fan 40 is rotated together with the first unit 21U. Thus, the cooling fan 40 is provided integrally with the first unit 21U, so that the air taken in from the outside by the cooling fan 40 passes through the inside of the first unit 21U without passing through the outside of the first unit 21U. That is, the amount (passing amount) of the air passing through the heat sink 30 is not so changed from the amount (intake amount) of the air taken in from the outside. Thus, by a simple constitution such that the cooling fan 40 is attached to the rotatable first unit 21U, the air taken in by the cooling fan 40 can be efficiently passed through the first unit 21U, so that improvement of the cooling efficiency of the heat sink 30 can be realized. Further, in this embodiment, compared with the conventional constitution, the cooling fan 40 can be disposed by being brought near to the heat sink 30, so that the cooling efficiency is easily improved.

Incidentally, in order to dispose the cooling fan 40 so as to be brought near to the heat sink 30, the cooling fan 40 may also be directly attached to the rear side plate 72 of the first unit 21U without providing the fan duct 41. However, the case where the fan duct 41 is provided as described above is advantageous since interference between the cooling fan 40 and the main assembly rear duct 84 can be avoided by using the rotating mechanism portion 500 having the above-described simple constitution.

Second Embodiment

Next, a recording material cooling device 20A in a second embodiment will be described with reference to FIGS. 7 and 8 while making reference to FIG. 2. FIG. 7 shows the case where the first unit 21U is in the contact position, and FIG. 8 shows the case where the first unit 21U is in the separated position. Incidentally, the second embodiment is only different from the above-described first embodiment in constitution of a rotating mechanism portion 500A, and other constitutions are the same as those of the above-described first embodiment. Accordingly, constituent elements which are the same as those in the above-described first embodiment are represented by the same reference numerals or symbols and will be omitted from description in this embodiment.

As shown in FIG. 7, in the rotating mechanism portion 500A, the rotation shaft 78 for the first rotation supporting member 76 and the second rotation supporting member 77 is disposed on a side closer to the main assembly rear side plate 82 side than the rear side plate 72 of the first unit 21U is and on a side above the horizontal line W passing through the center of the cooling fan 40 with respect to the direction. In order to realize such an arrangement, the first rotation supporting member 76 is provided so as to project upward from the rear side plate 72, and the second rotation supporting member 77 is provided so as to project from the rear side plate 74 of the second unit 25U toward the first rotation supporting member 76 positioned above the rear side plate 74. The second rotation supporting member 77 is formed in an L-shape, for example.

In the case of the rotating mechanism portion 500A, as shown in FIG. 8, during rotation of the first unit 21U, the cooling fan 40 moves in a direction in which the cooling fan 40 is separated (spaced) from the main assembly rear duct 84. At this time, as can be understood from comparison between FIGS. 7 and 8, with respect to the widthwise direction, the lower end portion 40*b* of the cooling fan 40 moves in a larger amount than the upper end portion 40*a* of the cooling fan 40 moves, so that the part of the cooling fan 40 does not enter the main assembly rear duct 84. In this case, the cooling fan 40 and the main assembly rear duct 84 can be made closer to each other than in the case of the above-described rotating mechanism portion 500. That is, in the case where the first unit 21U is in the contact position, the cooling fan 40 can be disposed at a position where the cooling fan 40 enters the main assembly rear duct 84 in advance.

In the case of the rotating mechanism portion 500 in the above-described first embodiment, when the cooling fan 40 is disposed at the position where the cooling fan 40 enters the main assembly rear duct 84 in advance, it becomes hard to rotate the first unit 21U. On the other hand, in the case of the rotating mechanism portion 500A in this embodiment (second embodiment), there is no such liability. Thus, in this embodiment (second embodiment), by providing the rotating mechanism portion 500A which moves in a direction in which the cooling fan 40 is separated from the main assembly rear duct 84 during rotation of the first unit 21U, the cooling fan 40 and the main assembly rear duct 84 can be made closer to each other than in the case of the conventional constitution. By this, cooling efficiency of the heat sink 30 can be improved.

However, the rotating mechanism portion 500 in the first embodiment is advantageous from the following viewpoints compared with the rotating mechanism portion 500A in the second embodiment. Advantageous points of the rotating mechanism portion 500 is, at first, that the constitution is simple, and secondly, that even when the first unit 21U is rotated, the user easily removes the recording material S without breaking the stagnated recording material S. That is, in the case of the second embodiment, the cooling fan 40 is liable to protrude toward a side below the upper end surface 25*a* of the second belt 25 supporting the recording material S from below, so that there is a need to pay attention to this point.

Incidentally, in the second embodiment, the heat sink 30 which is a heavy structure is supported by the rotating mechanism portion 500A, and therefore, in order to withstand a large load, it is preferable that strength of each of the first rotation supporting member 76 and the second rotation supporting member 77 is enhanced compared with the case of the first embodiment. Or, it is desirable that another means, other than the first and second rotation supporting members 76 and 77, such that the heat sink 30 is hoisted up by a wire or the like is added.

Other Embodiments

Incidentally, in the above-described first and second embodiments, the constitution in which the first unit 21U includes the heat sink 30 and in which the second unit 25U does not includes the heat sink 30 was described, but a constitution in which the second unit 25U also includes the heat sink 30 may also be employed.

In the above-described first and second embodiments, the case where the recording material cooling device 20 was provided in the apparatus main assembly 100A of the image forming apparatus 100 was described as an example (FIG. 1), but the present invention is not limited thereto. For example, the recording material cooling device 20 may also be provided outside the image forming apparatus 100. FIG. 9 shows an image forming system 1X in which the recording material cooling device 20 is provided outside the image forming apparatus.

The image forming system 1X as shown in FIG. 9 includes the image forming apparatus 100 and an external cooling device 101 connected to the image forming apparatus 100. The external cooling device 101 is constituted as one of peripheral devices (called option units or the like) capable of being retrofitted to the apparatus main assembly 100A in order to extend the function of the image forming apparatus 100, so as to be connectable to the apparatus main assembly 100A of the image forming apparatus 100. The external cooling device 101 is provided for lowering a temperature of the recording material S, high compared with the temperature before fixing, to not more than a predetermined temperature by cooling the recording material S discharged from the image forming apparatus 100. The external cooling device 101 includes the above-described recording material cooling device 20 for cooling the recording material S.

The recording material S cooled by the external cooling device 101 is discharged from the external cooling device 101 by a discharging roller pair 85 and is stacked on a (sheet) discharge tray 120. The discharge tray 120 is provided so as to be mountable to and dismountable from the external cooling device 101 or the image forming apparatus 100. That is, in the case where the external cooling device 101 is not connected to the image forming apparatus 100, the discharge tray 120 is mounted to the image forming apparatus 100 (FIG. 1). Further, when the external cooling device 101 is connected to the image forming apparatus 100, the discharge tray 120 is dismounted from the image forming apparatus 100 and then is mounted to the external cooling device 101 by the user or an operator. Incidentally, as the peripheral machine, a plurality of external cooling devices 101 may also be connected. By increasing the number of external cooling devices 101 to be connected, the operator is capable of easily improving cooling power of the recording material S in the already-installed image forming apparatus 100.

Incidentally, the image forming system 1X may also have a constitution in which the external cooling device 101 is connected to the image forming apparatus 100 incorporating therein the recording material cooling device 20. Further, the image forming system 1X may also have a constitution in which another sheet processing device such as a curl rectifying device is interposed between the image forming apparatus 100 and the external cooling device 101 and may also have a constitution in which a sheet processing device is connected to the external cooling device 101 on a side downstream of the external cooling device 101 with respect to the sheet feeding direction.

According to the present invention, in the case of a constitution in which the belt unit including the belt and the cooling member for cooling the belt in contact with the belt by dissipating heat is rotatable and in which the cooling member is cooled by blowing the air to the cooling member by the fan, improvement in cooling efficiency of the cooling member can be realized with a simple constitution when compared with the conventional constitution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2020-091181 filed on May 26, 2020 and 2021-064780 filed on Apr. 6, 2021, which are hereby incorporated by reference herein in their entirety.

What is claimed is:

1. A recording material cooling device for cooling a recording material on which a toner image is fixed by heating, said recording material cooling device comprising:

a belt unit including a rotatable endless belt, a plurality of rollers for stretching said belt, and a cooling member for cooling said belt by dissipating heat in contact with an inner peripheral surface of said belt;

a rotatable member configured to form a nip between itself and said belt in contact with an outer peripheral surface of said belt and configured to nip and feed the recording material in the nip;

a rotating unit capable of rotating said belt unit between a contact position where said belt and said rotatable member are in contact with each other so as to form the nip and a separated position where said belt and said rotatable member are in separation from each other so as to release the nip; and a fan unit including a fan for cooling said cooling member by generating airflow passing through said cooling member, said fan unit being rotatable together with said belt unit, wherein said belt unit includes a first holding member and a second holding member which are configured to rotatably support shafts of said rollers and which hold said cooling member;

wherein said rotating unit includes a rotation shaft extending in the recording material feeding direction and a rotation supporting member which is fixed to said second holding member and which rotatably supports said belt unit by said rotation shaft, and wherein said fan unit is mounted on said second holding member.

2. A recording material cooling device according to claim 1, wherein said rotating unit rotates said belt unit so that an upper end portion of said fan unit with respect to a vertical direction moves in a widthwise direction perpendicular to both the vertical direction and the feeding direction more than a lower end portion of said fan unit with respect to the vertical direction moves.

3. A recording material cooling device according to claim 1, wherein said rotation shaft is positioned below a horizontal rectilinear line passing through a rotation center of said fan.

4. A recording material cooling device according to claim 1, wherein said rotating unit rotates said belt unit so that a lower end portion of said fan unit with respect to a vertical direction moves in a widthwise direction perpendicular to both the vertical direction and the feeding direction more than an upper portion of said fan unit with respect to the vertical direction moves.

5. A recording material cooling device according to claim 1, wherein said rotation shaft is positioned above a rectilinear line passing through a rotation center of said fan.

6. A recording material cooling device according to claim 1, wherein said fan unit includes a duct which is provided between said belt unit and said fan and in which air flow generated by said fan is formed.

7. A recording material cooling device according to claim 1, wherein said fan is an exhaust fan for exhausting air to an outside of said recording material cooling device.

8. A recording material cooling device according to claim 1, wherein said cooling member is a heat dissipation plate for dissipating air in contact with said belt.

9. A recording material cooling device according to claim 1, wherein said rotatable member is another endless belt, and wherein said belt and said another endless belt form the nip in which the recording material is nipped and fed.

10. An image forming apparatus comprising:

an image forming unit configured to form a toner image on a recording material;

a fixing device configured to fix the toner image, formed by said image forming unit, on the recording material by heating the toner image; and a recording material cooling device according to claim 1.

11. An image forming system comprising:

an image forming apparatus including an image forming unit for forming a toner image on a recording material and a fixing device for fixing the toner image on the recording material, on which the toner images are formed, by heating; and a recording material cooling device according to claim 1, which is connected to said image forming apparatus and which cools the recording material discharged from said image forming apparatus.

12. A recording material cooling device according to claim 1, further comprising a main assembly configured to accommodate said belt unit, said rotatable member, said rotating unit and said fan unit inside thereof, wherein said belt unit is rotatable between the contact position and the separated position inside of said main assembly by said rotating unit.

13. A recording material cooling device according to claim 12, further comprising an exhaust duct fixed to said main assembly and configured to exhaust air sucked by said fan, wherein at least of a part of said fan unit enters said exhaust duct in a state in which said belt unit is positioned at the separated position.

14. A recording material cooling device according to claim 13, wherein an upper end portion of said fan unit enters said exhaust duct said in the state in which said belt unit is positioned at the separated position.

* * * * *